US005138778A

United States Patent [19]

Brandolini

[11] Patent Number: 5,138,778

[45] Date of Patent: Aug. 18, 1992

[54] STEAM IRON HAVING VALVED DEMINERALIZING CARTRIDGE AND SECONDARY DEMINERALIZED RESERVOIR

[75] Inventor: Jean-Louis Brandolini, Saint-Etienne, France

[73] Assignee: SEB, S.A., France

[21] Appl. No.: 709,979

[22] Filed: Jun. 4, 1991

[30] Foreign Application Priority Data

Jun. 11, 1990 [FR] France ..... 90 07218

[51] Int. Cl.[5] ..... D06F 75/18

[52] U.S. Cl. ..... 38/77.8; 38/77.3; 38/77.5; 210/282

[58] Field of Search ..... 38/75, 77.8, 77.3, 77.81, 38/77.82, 88; 210/94 , 282

[56] References Cited

U.S. PATENT DOCUMENTS

| | | | |
|---|---|---|---|
| 2,749,307 | 6/1956 | Ellison | 210/94 |
| 4,459,771 | 7/1984 | Ogata | 38/77.8 |
| 4,484,399 | 11/1984 | Biancalani | 38/77.8 X |
| 4,565,019 | 1/1986 | Cavalli | 38/77.6 |
| 4,657,672 | 4/1987 | Allen | 210/94 |
| 4,740,296 | 4/1988 | Roman | 210/94 |
| 4,770,768 | 9/1988 | Lang | 210/94 |
| 4,920,668 | 5/1990 | Henneberger et al. | 38/77.81 X |
| 4,927,533 | 5/1990 | Takase et al. | 210/282 X |
| 4,969,393 | 11/1990 | Mahlick et al. | 38/77.8 X |
| 5,063,697 | 11/1991 | Valente et al. | 38/77.8 X |

FOREIGN PATENT DOCUMENTS

| | | | |
|---|---|---|---|
| 0306623 | 6/1988 | European Pat. Off. . | |
| 2924300 | 12/1980 | Fed. Rep. of Germany | 38/77.8 |
| 3033964 | 4/1982 | Fed. Rep. of Germany | 38/77.8 |
| 2632331 | 12/1989 | France | 38/77.6 |
| 2033000 | 2/1987 | Japan | 38/77.3 |
| 3171600 | 7/1988 | Japan | 38/77.3 |
| 0422705 | 4/1967 | Switzerland . | |
| 1341304 | 9/1987 | U.S.S.R. | 38/77.81 |
| 1014399 | 12/1965 | United Kingdom . | |

*Primary Examiner*—Werner H. Schroeder
*Assistant Examiner*—Ismael Izaguirre
*Attorney, Agent, or Firm*—Finnegan, Henderson, Farabow, Garrett & Dunner

[57] ABSTRACT

A non-scaling electric steam iron has a heating sole plate (1), a steam chamber (3), a water reservoir (5), a feed device (6) for supplying water to the steam chamber, and a demineralizing cartridge (7) placed in the water circuit which connects the reservoir (5) to the steam chamber (3). The demineralizing cartridge (7) is placed in a removable manner between the primary plain-water reservoir (5) and a secondary demineralized-water reservoir (25) which communicates with the water feed device (6). The cartridge (7) communicates with the Primary reservoir (5) and the secondary reservoir (25) by the use of valves (**27*a*,27*b***) which prevent any outflow of water when the cartridge is removed from the iron.

22 Claims, 4 Drawing Sheets

STEAM IRON HAVING VALVED DEMINERALIZING CARTRIDGE AND SECONDARY DEMINERALIZED RESERVOIR

FIELD OF THE INVENTION

The present invention relates to an improved electric steam iron having a demineralizing cartridge.

DESCRIPTION OF THE RELATED ART

Known steam irons are equipped with a heating sole-plate having an electric heating resistor, a water reservoir, a steam chamber, and a feed device for supplying water to the steam chamber. This assembly is covered by a protective casing in which a handle for the iron is usually incorporated.

A steam iron of the type just mentioned was proposed in French patent Application No. 89 07580 filed in the name of the present Applicant on Jun. 8, 1989. In addition to the elements referred-to above, this iron has a demineralizing cartridge placed in the water circuit which connects the reservoir to the steam chamber.

The cartridge is filled with an ion-exchange resin which has the effect of removing elements such as carbonate of lime from the water, these elements being responsible for scale formation in the steam chamber and in the steam discharge holes formed in the sole-plate of the iron.

Furthermore, the removable character of this cartridge gives rise to a problem of leak-tightness between the reservoir and the duct which communicates with the feed device of the steam chamber.

The object of the present invention is to make improvements in the steam iron described in the French patent Application cited earlier.

SUMMARY OF THE INVENTION

The invention is directed to an electric steam iron comprising a heating sole-plate, a steam chamber, a water reservoir, a feed device for supplying water to the steam chamber, a demineralizing cartridge placed in the water circuit which connects the reservoir to the steam chamber, the entire assembly being covered by a protective casing.

In accordance with the invention, the steam iron is distinguished by the fact that the demineralizing cartridge is placed in a removable manner between a primary plain-water reservoir and a secondary demineralized-water reservoir which communicates with the water feed device, the cartridge being adapted to communicate with the primary reservoir and the secondary reservoir by means of valves which prevent any outflow of water when the cartridge is withdrawn from the iron.

Thus the cartridge forms a physical separation between two reservoirs containing plain water and demineralized water respectively. The valves make it possible to remove the cartridge and to replace it by a fresh cartridge without any outflow of water from one of the reservoirs.

In an advantageous embodiment of the invention, the rear portion of the iron casing has an extension beyond the rear edge of the sole-plate, the demineralizing cartridge being housed within said rear portion and located at a sufficient distance from the sole-plate to prevent any overheating of said cartridge.

The ion-exchange resin contained in the demineralizing cartridge is not capable of withstanding a very high temperature, in particular the temperature rise produced by the heating sole-plate and the wall of the steam chamber.

By virtue of the arrangement of the cartridge within a rear portion of the iron located beyond the rear edge of the sole-plate, the cartridge is sufficiently remote from the sole-plate to guard against any overheating which would be liable to make the resin inactive.

This was not an obvious arrangement in the case of a steam iron.

In an advantageous embodiment of the invention, the demineralizing cartridge is removably fitted within a housing which is connected to the water reservoir.

This connection between the cartridge housing and the reservoir involves a condition of heat exchange between the reservoir which contains cold water (supplied from a faucet) and the cartridge, which plays a contributory role in maintaining the resin contained in the cartridge at low temperature.

Preferably, the water reservoir extends in a direction substantially parallel to the heating sole-plate and at a certain distance above this latter, the bottom wall of the cartridge housing being located substantially in the line of extension of the bottom wall of the reservoir.

Thus the arrangement of the cartridge does not affect the overall height of the iron.

In a preferred embodiment of the invention, the top wall of the cartridge housing is adjacent to the interior of the water reservoir.

This wall of the housing thus forms part of the reservoir wall, with the result that the housing is integral with the reservoir.

Moreover, the housing wall makes it possible to maintain the resin at low temperature by heat exchange with the water of the reservoir.

In an advantageous embodiment of the invention, the top wall of the housing is inclined towards the front of the iron, said top wall being joined to the bottom of the water reservoir by means of a cant face. The rear edge of the cant face is joined to the top wall of the housing by means of a transverse partition which forms with said top wall a receptacle constituting a reserve of water.

Said cant face permits a supply of water to the cartridge in "waves" of water which are formed as the iron is displaced in back-and-forth motion.

The waves thus formed are poured into the reserve-supply receptacle which communicates with the cartridge inlet.

DESCRIPTION OF THE PREFERRED EMBODIMENTS

Figure 1:
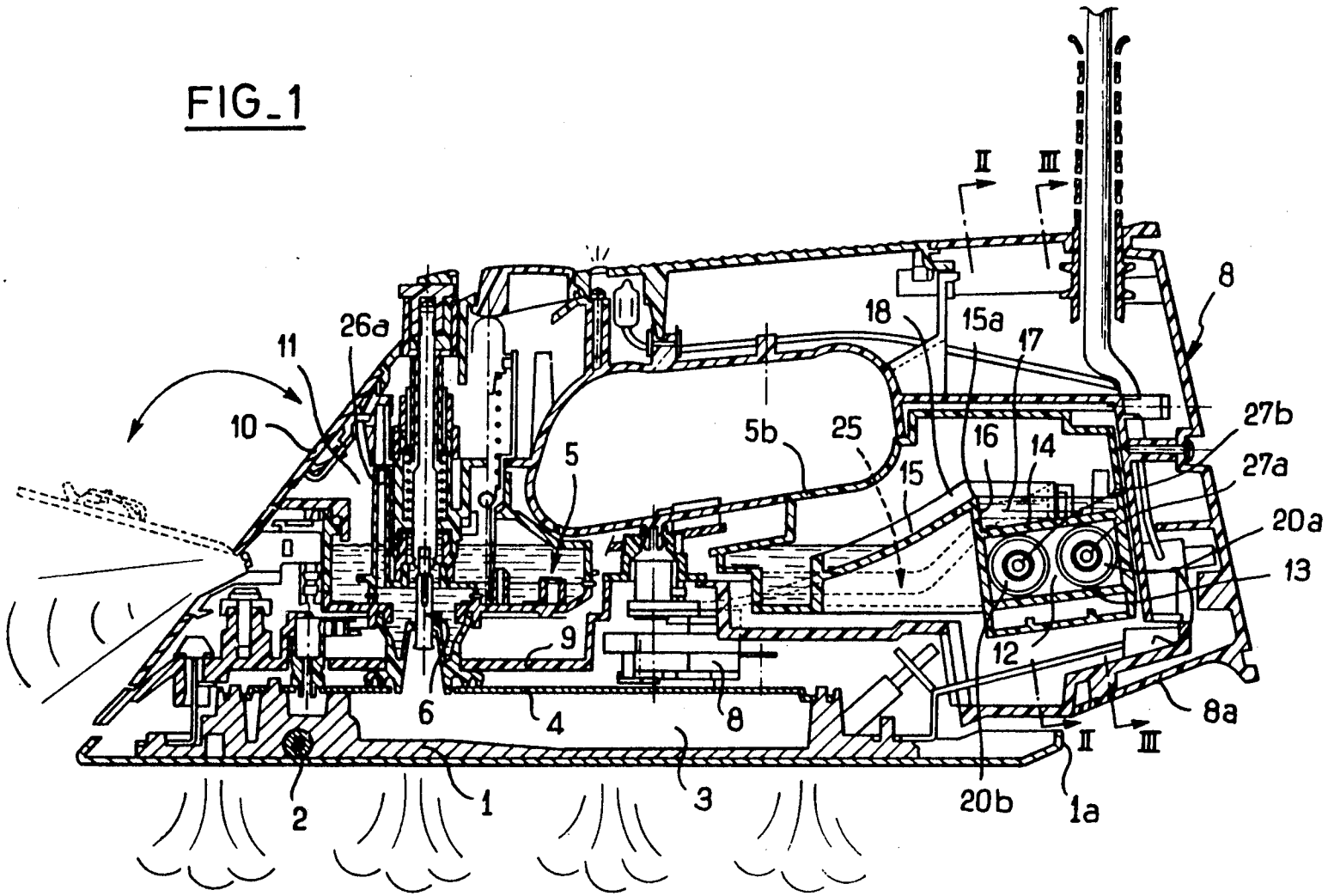
FIG. 1 is a longitudinal sectional view of a steam iron in accordance with the invention.
Figure 2:
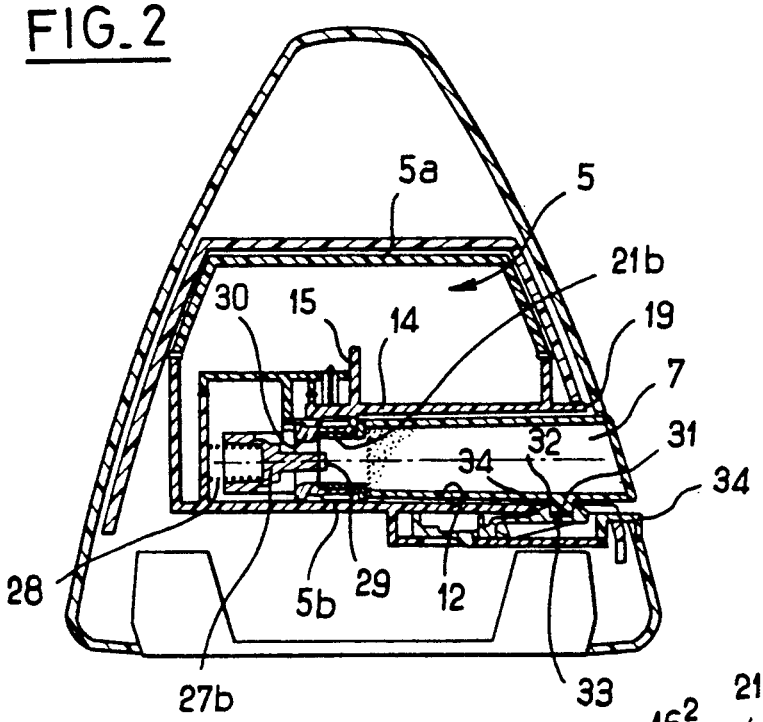
FIG. 2 is a sectional view taken along the plane II—II of FIG. 1.
Figure 3:
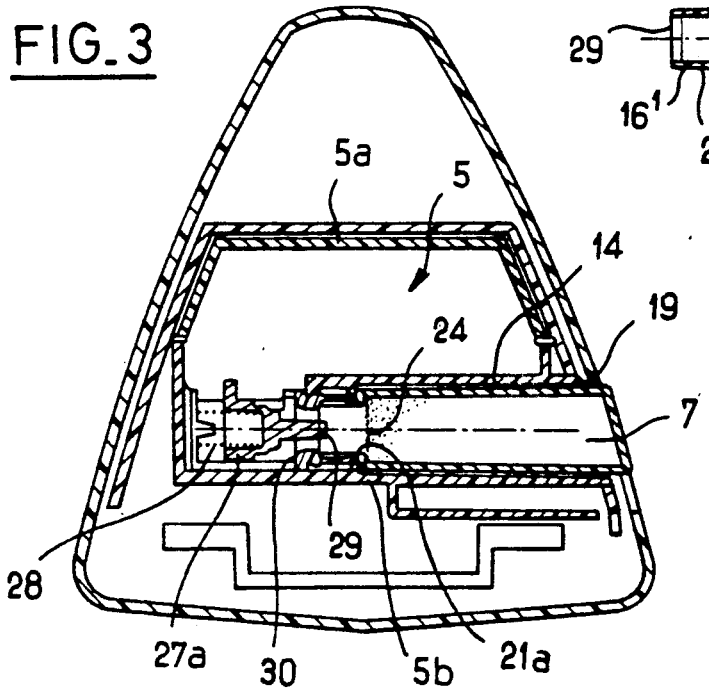
FIG. 3 is a sectional view taken along the plane III—III of FIG. 1.

In the embodiment of FIGS. 1 to 3, the electric steam iron comprises a heating sole-plate 1 containing an electric resistor 2, a steam chamber 3 closed by a metallic wall 4, a water reservoir 5, a feed device 6 for supplying water "drop by drop" to the steam chamber 3, and a demineralizing cartridge 7 (see FIGS. 2, 3 and 4) placed within the water circuit which connects the reservoir 5 to the steam chamber 3.

The assembly formed by the elements mentioned in the foregoing is covered by a protective casing 8.

The water reservoir 5 extends horizontally between the front and rear ends of the iron, above the steam chamber 3. A wall 9 of plastic material having a relatively substantial thickness forms a separation between the water reservoir 5 and the top wall of the steam chamber 3 and provides heat insulation between the reservoir and the hot bottom portion of the iron.

The front portion of the iron has a flap 10 which provides access to an opening 11 through which water (usually tap water) can be introduced into the reservoir 5.

Other details appearing in FIG. 1 are well-known to those versed in the art and consequently do not need to be described in detail here.

The deminealizing cartridge 7 is removably fitted within a housing 12 located between a primary plain-water reservoir 5 and a secondary demineralized-water reservoir 25 which communicates with the water feed device 6. The cartridge 7 communicates with the primary reservoir 5 and the secondary reservoir 25 by means of valves **27*a*, 27*b*** which prevent any outflow of water when the cartridge is removed from the iron.

In the embodiment shown in the drawings, the secondary reservoir 25 is placed within the primary reservoir 5. In addition, the secondary reservoir 25 is constituted by two cavities **25*c* and 25*b* located respectively at the outlet of the cartridge 7 and around the feed device 6** of the steam chamber.

Moreover, the volume of the secondary reservoir 25 makes it possible to supply the feed device 6 of the steam chamber when the device is open at its maximum delivery, over a period of at least thirty seconds.

Furthermore, each reservoir 5 and 25 has means for connecting to the atmosphere in order to prevent the development of one or a number of negative-pressure zones as water flows towards the steam chamber. One of these means consists of a tube **26*a* placed in the immediate vicinity of the steam chamber feed device 6**.

More specifically, the secondary reservoir 25 is made up of the following elements (see FIGS. 5 and 6):

- a cavity **25*c* containing the check-valve 27 at the outlet of the cartridge 7**;
- a duct **25*a* located on or beneath the bottom wall of the reservoir 5, made integral with the reservoir by means of at least one of its walls (as illustrated), or constituted by a flexible tube which provides a connection between the two cavities 25*c* and 25*d*. Said duct can also be constituted by the space located between the bottom of the reservoir 5** and a second wall (inner or outer wall) which covers all or part of the bottom in order to increase the volume of demineralized water without modifying the pressure drop;
- a cavity **25*d* surrounding the feed device 6** of the steam chamber.

The check-valve 27 of the secondary reservoir may be dispensed with in order to reduce the pressure drop towards the cavity 25 if the instructions for use stipulate that the user should leave the iron in a flat position on its sole-plate. This position allows little water to escape owing to the shape and the levels of the two cavities which constitute the secondary reservoir 25.

It is also apparent from FIG. 1 that the rear wall **8*a* of the casing 8 is extended beyond the rear edge 1*a* of the sole-plate 1 and that the housing 12 of the demineralizing cartridge 7 is located within said rear portion. Said housing 12 is thus located at a sufficient distance from the sole-plate 1** to avoid any overheating of the resin contained in the cartridge.

The demineralizing cartridge 7 is removably fitted within the housing 12 which is integral with the rear portion of the water reservoir 5.

It is also apparent from FIG. 1 that the bottom wall 13 of the housing 12 of the cartridge 7 is located substantially at the same level as the bottom wall **5*a* of the reservoir 5**.

Moreover, the top wall 14 of the housing 12 of the cartridge 7 is adjacent to the interior of the water reservoir 5.

In addition, said top wall 14 is inclined towards the front end of the iron and is joined to the bottom wall **5*a* of the water reservoir by means of a cant face 15. The rear edge 15*a* or summit of this cant face 15 is joined to the top wall 14 of the housing 12 by means of a transverse partition 16 which forms with said wall 14 a receptacle 17** constituting a water reserve.

Figure 5:
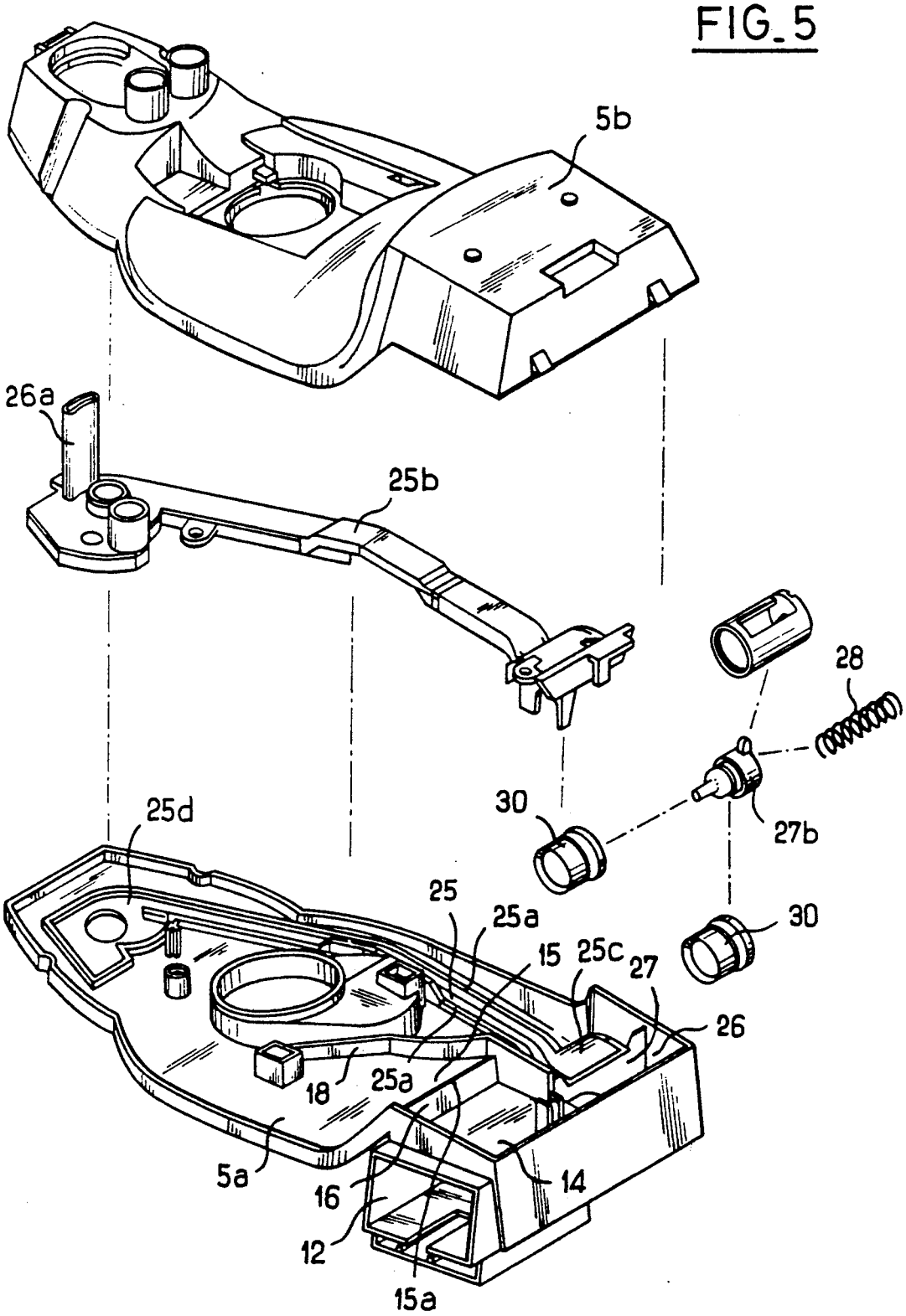
FIG. 5 is an exploded view in perspective showing the different parts of the water reservoir.

It is seen from FIG. 5 that the housing 12 of the cartridge 7 is molded in one piece with the bottom wall **5*a* of the reservoir 5**.

Moreover, this figure shows that the cant face 15 extends over only part of the width of the water reservoir and its edge has a vertical flange 18.

Figure 4:
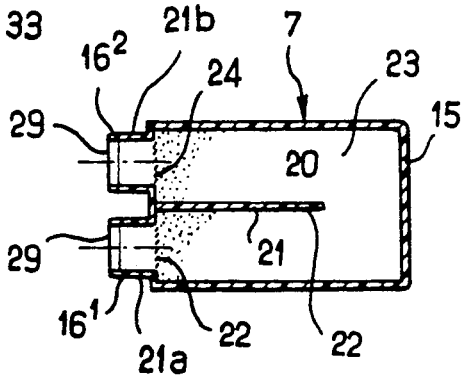
FIG. 4 is a sectional view of the demineralizing cartridge along a plane which passes through the axes of the cartridge inlet and the cartridge outlet.

As shown in FIGS. 1 to 3, the housing 12 of the cartridge 7 is provided on the face remote from its entrance face 19 which opens to the exterior with an admission opening **20*a* and a discharge opening 20*b* which are removably connected to an end-piece for admission of water 21*a* and for discharge of water 21*b* into and from the cartridge 7 (as shown in FIG. 4). This cartridge 7 has a central partition 22. A filtration grid 24 which retains the resin particles 23 extends to the rear of the end-pieces 21*a* and 21*b***.

The discharge opening **20*b* of the housing 12 is connected to the water feed device 6 of the steam chamber 3 by means of the duct 25 which extends within the water reservoir 5**.

Moreover, the opening **20*a* for admission of water into the cartridge 7 opens into a compartment 26 which is separated from the discharge opening 20*b* by a partition 20*c*. This compartment 26 is supplied with water contained in the receptacle 17 forming a reserve and is directly supplied with water from the reservoir 5** proper only when the iron is in the vertical position, as will be explained in greater detail hereinafter.

FIG. 5 shows in addition that a portion **25*a* of the duct 25 is molded in one piece with the bottom wall 5*a* of the reservoir. The other portion which covers the portion 25*a* of the duct is designated by the reference 25*b* in FIG. 5. At the end remote from the discharge opening 20*b* of the housing 12, said portion of duct 25*a* has an extension in the form of a vertical duct 26*a*** which serves to establish a communication with the surrounding atmosphere.

As shown at the top of FIG. 5, the upper portion 5*b* of the reservoir is intended to be fitted on the portion 5*a* which forms the bottom of the reservoir 5.

In addition, the reservoir is provided with valves 27*a*, 27*b* located opposite to the inlet 21*a* and outlet 21*b* of the cartridge 7, each valve being controlled by a spring 28 which tends to thrust the cartridge 7 outwards. Said valves 27*a*, 27*b* are held open by contact with stops 29 formed on the end-pieces 21*a* and 21*b* of the cartridge when it is engaged within the housing 17. Said valves 27*a*, 27*b* shut-off the inlet 20*a* and the outlet 20*b* of the housing under the action of the springs 28 which apply said valves against flexible seals 30 engaged on the end-pieces 21*a*, 21*b* when the cartridge 7 is removed from the housing 12.

Moreover, as shown in FIG. 2, means are provided for locking and releasing the cartridge relatively to the housing 12. These means are adapted to cooperate by snap-action engagement in order to ensure locking and include an element which is accessible to the user in order to initiate release of the cartridge.

In FIG. 2, it is shown that the bottom face of the cartridge 7 has a lug 31 which is retained within a recess 32 forming part of a resilient tongue 33, said tongue being attached to a push-button 34 which is slidably mounted beneath the housing 12. The tongue 33 is provided in front of the recess 32 with a ramp 35 which causes downward displacement of the tongue 33 when pressure is applied on the push-button 34. This movement frees the lug 31 from the cartridge 7 which is then pushed outwards by the springs 28. Disengagement of the cartridge 7 automatically places the valves 27*a* and 27*b* in the closed position in which they are applied against the flexible seals 30.

Referring now to the diagrams of FIGS. 6 and 7, the operation involved in the supply of water to the steam chamber from the water reservoir 5 will now be described.

Figure 6:
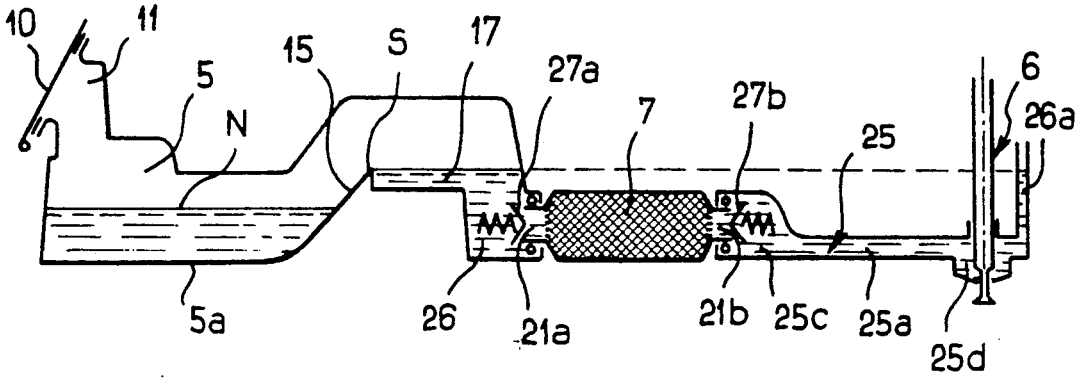
FIG. 6 is a schematic view illustrating the operation when the iron is in the normal position of use.

In FIG. 6, the different parts of the water supply circuit have been placed end to end for the sake of enhanced clarity. In this FIG. 6, the level N of water contained in the reservoir 5 is below the summit S of the cant face 15 located between the bottom wall 5*a* of the reservoir 5 and the receptacle 17 which communicates with the cartridge 7.

In consequence, when the iron is stationary, only the water contained in the receptacle 17 supplies the flow-regulating device 6 which discharges water drop by drop into the steam chamber. The water which passes through the cartridge 7 is freed from all elements such as calcium ions which would be liable to result in scaling of the steam chamber.

When ironing is in progress, displacement of the iron forms waves in the water contained in the reservoir 5 so that the water is thus capable of flowing up the cant face 15 and of being successively poured into the receptacle 17, a substantially constant water level being thus maintained within said receptacle.

Since this level is maintained constant, the rate of flow of water through the feed device 6 is uniform.

Figure 7:
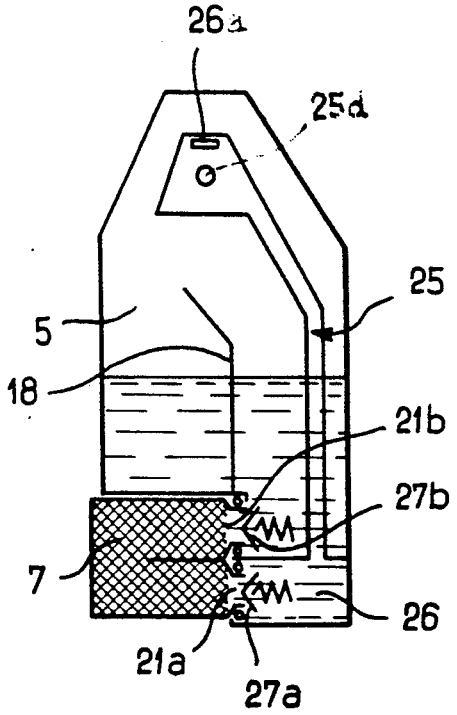
FIG. 7 is a schematic view illustrating the operation when the iron is in the vertical position of rest.

In the vertical position of rest of the iron as shown in FIG. 7, the water of the reservoir 5 also fills the receptacle 17, the cartridge 7 and the duct 26.

Thus, when the user brings the iron to a horizontal position for an ironing operation, the receptacle 17 which forms a water reserve is filled with water, with the result that the iron is ready to operate.

In order to change the cartridge 7, it is only necessary to depress the push-button 34 in order to release it from its housing 12. At the time of removal of the cartridge 12, the valves 27*a*, 27*b* which are controlled by the springs automatically close the water inlet and outlet so that the water of the reservoir 5 cannot flow out to the exterior.

It is then only necessary to engage a fresh cartridge within the housing 12. Full engagement of the cartridge within the housing 12 automatically initiates opening of the valves 27*a*, 27*b*.

The external wall of the cartridge 7 is preferably of transparent plastic in order to make it possible to examine the change of color of the product located inside, thus enabling the user to determine whether it is necessary to replace the cartridge.

By way of example, the volume of the primary reservoir 5 is 220 $cm^3$ and the volume of the secondary reservoir is 7 $cm^3$. In the event that the cartridge is inadvertently closed, this makes it possible to ensure thirty seconds of steam production, the maximum delivery of this iron being 15 g of steam per minute. The volume of the secondary reservoir may be increased (in particular by increasing the cross-sectional area of the duct 25) but without any practical consequence since the steam delivery is not essentially dependent on the water flow rate but on the electric power of the sole-plate.

In order to ensure that the primary and secondary reservoirs are capable of emptying freely or of achieving a state of free equilibrium when the iron is in position on the heel, each reservoir must be in communication with atmospheric pressure (via the tube 26*a* and via the inlet neck). This double connection to the atmosphere is made necessary by the presence of the ion-exchange resin contained in the cartridge 7 which produces a substantial pressure drop. This mass, through which the stream of water cannot readily flow, would produce a partial vacuum within the secondary reservoir at the time of emptying into the steam chamber if the tube 26*a* did not exist, thus considerably reducing the flow.

It will be readily understood that the invention is not limited to the example of construction which has been described in the foregoing and any number of modifications may accordingly be contemplated without thereby departing either from the scope or the spirit of the invention.

What is claimed is:

1. An electric steam iron comprising an assembly of a heating sole-plate (1), a steam chamber (3), a primary plain-water reservoir (5), a feed device (6) for supplying water to the steam chamber, and a demineralizing cartridge (7) placed in a water circuit which connects the reservoir (5) to the steam chamber (3), the entire assembly being covered by a protective casing (8), wherein the iron further includes a secondary demineralized water reservoir (25) and the demineralizing cartridge (7) is removably placed between the primary plain-water reservoir (5) and the secondary demineralized-water reservoir (25) which communicates with the water feed device (6), the cartridge (7) being in fluid communication with the primary reservoir (5) and the secondary reservoir (25) by valve means (27*a*, 27*b*) which prevent any outflow of water when the cartridge is removed from the iron.

2. The iron according to claim 1, wherein the cartridge (7) is removably fitted within a housing (12) located between the two reservoirs (5, 25).

3. The iron according to claim 2, wherein the housing has at least one wall (12) adjacent to the two reservoirs.

4. The iron according to claim 1, wherein the secondary reservoir (25) is placed within the primary reservoir (5).

5. The iron according to claim 1, wherein the secondary reservoir (25) is formed by two cavities (25*c*, 25*d*) located respectively at an outlet of the cartridge (7) and around the feed device (6) of the steam chamber.

6. The iron according to claim 1, wherein a volume of the secondary reservoir (25) supplies the steam chamber feed device (6) with water when this device is open to provide maximum delivery, over a period of at least thirty seconds.

7. The iron according to claim 1, wherein each reservoir (5 and 25) has means for venting to the atmosphere in order to prevent the development of one or a number of negative-pressure zones as water flows towards the steam chamber.

8. The iron according to claim 7, wherein one of these means consists of a tube (26*a*) placed in the immediate vicinity of the steam chamber feed device (6).

9. The iron according to claim 1, wherein the housing (12) of the cartridge (7) is molded in one piece with a bottom wall (5*a*) of the reservoir (5).

10. The iron according to claim 1, wherein a rear portion (8*a*) of the casing of the iron is extended beyond a rear edge (1*a*) of the sole-plate (1), the demineralizing cartridge (7) being housed within said rear portion (8*a*) and located at a sufficient distance from the sole-plate (1) to avoid any overheating of said cartridge (7).

11. The iron according to claim 10, the water reservoir (5) extends substantially parallel to the heating sole-plate (1) and at a certain distance above said sole-plate, wherein a bottom wall (13) of the housing (12) of the cartridge is located substantially at the same level as a bottom wall (5*a*) of the reservoir (5).

12. The iron according to claim 11, wherein the top wall (14) of the housing (12) of the cartridge (7) is adjacent to an interior of the water reservoir (5).

13. The iron according to claim 12, wherein said top wall (14) is inclined towards the front of the iron.

14. The iron according to claim 12, wherein said top wall (14) of the housing (12) is joined to the bottom wall (5*a*) of the water reservoir (5) by means of a cant face (15).

15. The iron according to claim 14, wherein the cant face (15) extends over part of a width of the water reservoir (5).

16. The iron according to claim 14, wherein a rear edge (15*a*) of the cant face (15) is joined to the top wall (14) of the housing by a transverse partition (16) which forms with said top wall a receptacle (17) for retaining a reserve supply of water.

17. The iron according to claim 16, wherein the housing (12) of the cartridge (7) is provided on a face remote from an entrance face (19) thereon which opens to an exterior with an admission opening (20*a*) and a discharge opening (20*b*) which are removably connected to an endpiece for admission of water (21*a*) and for discharge of water (21*b*) into and from the cartridge (7).

18. The iron according to claim 17, wherein the discharge opening (20*b*) is connected to the water feed device (6) of the steam chamber by means of a duct (25) which extends within the primary water reservoir (5).

19. The iron according to claim 18, wherein the opening (20*a*) for admission of water into the cartridge (7) opens into a compartment (26) which is separated from a discharge opening (20*b*) by a partition (27), said compartment (26) being supplied with the water contained in the receptacle (17) which forms a reserve and said compartment being supplied directly with the water from the primary reservoir (5) proper only when the iron is in the vertical position.

20. The iron according to claim 18, wherein a portion (25*a*) of the duct (25) is molded in one piece with the bottom wall (5*a*) of the reservoir (5).

21. The iron according to claim 17, wherein the reservoir (5) is provided with valves (27*a*, 27*b*) located opposite to the inlet (21*a*) and outlet (21*b*) of the cartridge (7), each valve being controlled by a spring (28) which tends to thrust the cartridge (7) outwards, said valves (27*a*, 27*b*) being held open by contact with the cartridge (7) when the cartridge is engaged in the housing (12) and said valves (27*a*, 27*b*) shutting-off the inlet (20*a*) and the outlet (20*b*) of the reservoir under the action of the springs (28) when the cartridge is removed from the housing (12).

22. The iron according to claim 21, wherein means (31, 32, 33) are provided for locking and releasing the cartridge (7) with respect to the housing (12), said means cooperating by snap-action engagement in order to carry out the locking operation and being provided with an element (34) which is accessible to the user for carrying out the releasing operation.

* * * * *